United States Patent [19]

Greiler

[11] Patent Number: 4,626,734

[45] Date of Patent: Dec. 2, 1986

[54] SINGLE-BASED, HIGH-PRESSURE DISCHARGE LAMP AND SOCKET COMBINATION

[75] Inventor: Wolfgang Greiler, Unterhaching, Fed. Rep. of Germany

[73] Assignee: Patent-Treuhand-Gesellschaft für Elektrische Glühlampen mbH, Munich, Fed. Rep. of Germany

[21] Appl. No.: 715,185

[22] Filed: Mar. 22, 1985

[30] Foreign Application Priority Data

Apr. 3, 1984 [DE] Fed. Rep. of Germany ..... 3412489

[51] Int. Cl.[4] ..... H01J 5/50; H01J 61/30; H01R 33/74

[52] U.S. Cl. ..... 313/51; 313/634; 313/318; 313/113; 339/144 T

[58] Field of Search ..... 313/318, 113, 51, 634, 313/623; 339/186 T, 144 T, 145 T, 184 T; 362/263, 296

[56] References Cited

U.S. PATENT DOCUMENTS 4,533,851 8/1985 Block et al. ..... 313/51

FOREIGN PATENT DOCUMENTS 963968 7/1964 United Kingdom ..... 313/318

OTHER PUBLICATIONS

Osram Photokina '84 pp. 2–32.

*Primary Examiner*—Palmer C. DeMeo
*Attorney, Agent, or Firm*—Frishauf, Holtz, Goodman & Woodward

[57] ABSTRACT

To reduce the size of the base and a socket therefor of a single-ended, single-based, high-pressure discharge lamp, for example a mercury discharge lamp with halogen and noble gas additives therein, possibly including rare earths, a base (5) has a generally conically shaped portion (8) in the region adjacent the discharge vessel, the discharge vessel being formed with two supply shafts (3, 4) one of which is seated in a recess in the smaller part of the conical portion. The base is formed with a centering stub (9), preferably of rectangular cross section, and extending away from the discharge vessel, the centering stub having a lateral slot (11) within which one of the terminals (12) of the lamp is located. The other terminal is formed by a metal strip (14) carried through the cone surface and terminating laterally of the centering stub (9) at the side remote from the first terminal (12). The socket is formed with two chambers, separated by a rib or wall (19), one chamber receiving the centering stub (9) and having a connector (16) located therein, in form of a leaf spring, engaging within the slot (11) and against the one terminal (12) of the lamp; the second chamber, subdivided by the wall (19), retains the second terminal (17) to engage the end of the contact strip (14) and forming the second terminal (13) of the lamp. The socket as well as the base are made of temperature-resistant ceramic.

18 Claims, 3 Drawing Figures

SINGLE-BASED, HIGH-PRESSURE DISCHARGE LAMP AND SOCKET COMBINATION

Reference to related application, by th inventor hereof, assigned to the assignee of the present application, the disclosure of which is herebyincorporated by reference: U.S. Ser. No. 715,186, filed Mar. 22, 1985, GREILER.

Reference to related publication: German Patent Publicaton DE-OS 32 36 462, to which U.S. Pat. No. 4,533,851 corresponds.

The present invention relates to high-pressure discharge lamps, and more particularly to a base structure for a single-based, high-pressure discharge lamp, and to a socket therefore, as well as to a base lamp-socket combination.

BACKGROUND

High-pressure discharge lamps may use a discharge vessel which has two oppositely directed connecting elements in the form of shafts. The bulb is made of a suitable transparent material, typically glass, the current supply elements being connected trough the bulb material by being melted therein, for example through presses or pinch connections. One of the shafts can be directly connected to a base made of a heat-resistant, electrically insulated material, for example a ceramic. The base has two terminal elements, one of which is connected to a shaft, and the other to an electrical conductor which leads to the shaft remote from the one connected in the base.

The lamp to which the present invention relates is known, for example shown in the referenced U.S. Pat. No. 4,533,851, to which German Patent Disclosure Document DE-OS 32 36 462 corresponds. If such lamps have been operated, and are to be re-started, that is, are to be re-started under hot conditions, and require instantaneous re-starting, a starting voltage of more than 20 kV may be required to insure reliable re-starting and operating reliability with respect to the electrical data of the lamp. Due to the construction of the lamp, the base body is subjected to high thermal loading. The heat of the base body is transferred to the lamp unit, and may be transferred to a socket; the heating reduces the lifetime of the lamp and, after disconnection of electrical current, may delay cooling of the lamp unit itself. Current supply to one of the terminal elements previously was through an angled terminal element which leads to a comparatively long spacing between terminals, and hence an overdimensioned base structure. The size of the base structure then results in high heat capacity thereof, which is undesirable. If the lamp is to be introduced into a reflector, the apex of the reflector must be formed with an aperture large enough to receive the base, and an increase in the size of the base requires an increase in the cut-out of the reflector, thus reducing the light available from the lamp since less of the light can be reflected. An engagement surface of the base with an appropriate prior-art socket was formed by a collar at the lower side of the base, and surrounding the contacting terminal elements. The distance from the socket through the base to the lamp, thus, was increased, thereby reducing the accuracy with which the lamp itself can be positioned in a reflector, for example.

THE INVENTION

It is an object to improve the lamp-base combination so that it can be reduced in size, is less subject to heating, and permits precise positioning within a reflector. The electrical data should be the same as those of known lamps and bases, as well as lamp-socket combinations. It is a further object to provide a socket structure for combination with the base which permits accurate placement of the lamp, for example in a reflector.

Briefly, the base has a portion of generally conical shape in the region adjacent the discharge vessel, and is formed with a cylindrical centering stub, extending from the conical portion in the direction away from the discharge vessel. The cylindrical stub is formed with a lateral slot. A first contact terminal is located within the slot. The conical portion is formed with a reception recess in which the end portion of the discharge vessel is secured. A second electrical connection extends through the cone surface of the conical portion, and a second contact terminal is located adjacent the cylindrical stub at the side thereof opposite the slot, and hence away from said first contact terminal. The base is preferably made of ceramic.

The lamp can readily be fitted into a socket, and for easy handling of the lamp into a socket, the centering stub is preferably located in the continuastion of a longitudinal axis formed by the lamp and its connecting bolts. Preferably, the centering stub is non-round, for example rectangular, and on the side thereof remote from the discharge vessel is formed with a small extension of at least partially circular cross section, concentrically surrounding the terminal element thereof. The collar increases the resistance to flash-over of high voltage—for example for hot-starting—since edges and corners will be formed which reject the accumulation of contaminants, dirt or dust.

DRAWINGS

DETAILED DESCRIPTION

Figure 1:
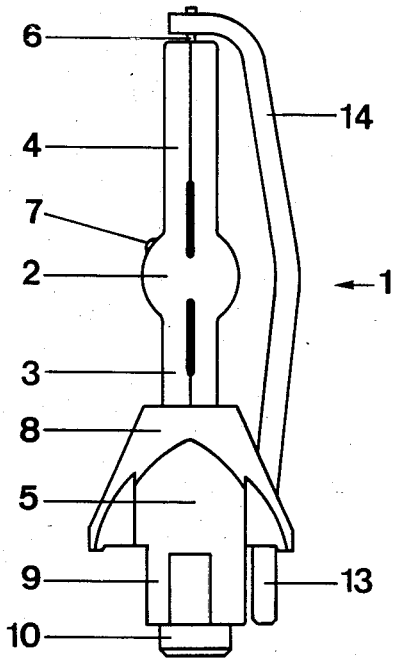
FIG. 1 is a side view of the lamp with the base structure therefor.

The high-pressure discharged lamp 1 has a discharge vessel 2 with two oppositely located shafts 3, 4 and a ceramic base 5. A current supply lead 6 extends from shaft 4; shaft 3 terminates in an opening of the base 5 and is secured therein. The discharged vessel 2 is filled with mercury, several metal halogens and a noble gas and is evacuated and tipped off at a pumping tip 7. The construction may be used for other types of high-pressure lamps, for example high-pressure lamps without halogen additives or for a noble gas discharge lamp.

Figure 2:
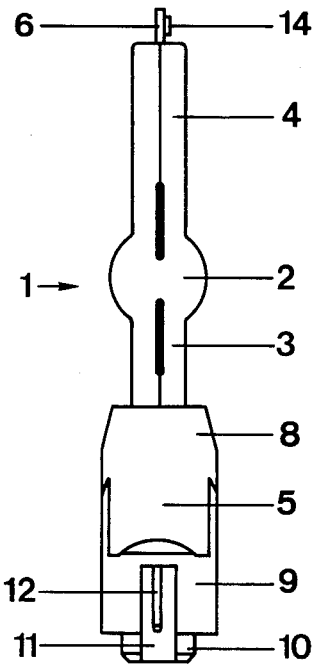
FIG. 2 is a side view of th lamp, rotated 90° with respect to FIG. 1.

The single base 5 has an upper portion 8, facing the discharge vessel 2. The upper portion 8 has essentially conical form, which continues or merges in a centering stub 9. The cone angle of the cone 8 is so selected that the theoretical extension of its surface lines forms an intersection within the discharge vessel 2. As can be seen in the view of FIG. 2, the cone 8 is symmetrically cut off at both sides. The centering stub 9 a rectangular cross section and is extended in the direction away from the discharge vessel 2 by a short round collar 10.

A slot 11 extends axially over almost the entire length of the centering stub 9 and the collar 10. The slot 11 permits access to a connecting terminal pin 12. The connecting terminal pin 12 is located within the slot 11, with clearance thereabout. The connecting terminal 12 is provided to connect the necessary high voltage, required for firing or ignition of the high-pressure lamp, to the lamp. A current supply, melted into the shaft 3—and not shown in FIGS. 1 and 2—is secured, for example by welding, to the connecting terminal 12.

A second connecting terminal 13 is secured to the base, located outside of the centering stub 9 at the side remote from the slot 11. It is formed by a preformed, stiff, flat metal tape or ribbon 14 made of nickel-plated copper, welded to the current supply lead 6 of the lamp shaft 4, and carried through a slot or opening in the surface of the cone 8 of the conical portion of the base. Attachment of the shaft of the lamp 3 in the base, as well as attachment of the metal ribbon or strip 14 in the lower region of the cone 8 is preferably by cement.

Figure 3:
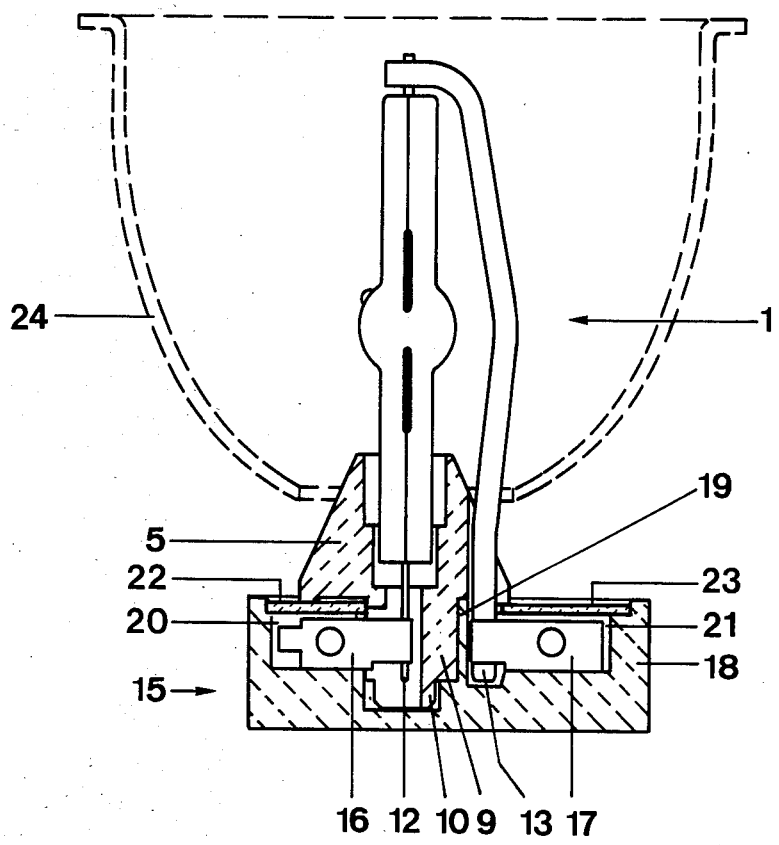
FIG. 3 is an axial sectional view of the base in a socket, and showing the installation of the lamp in a reflector.

The single base is designed for association with a socket 15—see FIG. 3. The socket 15 has contact terminal elements 16, 17 in the form of leaf springs, extending laterally—with respect to the connecting terminal pins 12, 13—in the socket. The leaf springs are so made that they frictionally, by wiping contact, and with spring force, engage against and/or around the terminal pins 12, 13. A contact element 16 extends into the slot 11 of the centering stub 9. The centering stub 9 as well as the collar 10 are fitted into a centering reception opening or chamber formed in the socket structure 18. the contact elements 16 and 17 are located in separate chambers 20, 21, separated by a wall 19. The wall 19 engages against the side of the centering stub 9 of the base 5 of the lamp remote from the terminal 12. The upper openings of the chambers 20, 21 only permit access for the centering stub 9 with its collar 10, and the terminal connecting pins 12 and 13. Cover plates 22, 23, of ceramic or mica, close of the chambers 20, 21.

The high-pressure discharge lamp 1 can be located within a reflector 24. As can be seen, the opening at the apex of the reflector can be small.

The metal halogen high-pressure discharge lamp 1, preferably, is operated with square wave supply having an open circuit voltage of more than 250 V. The lamp is particularly suitable for film or television studio use without flicker. The lamp may be used, however, also for projection purposes, for example for slide projectors and other uses. For ignition, and particularly for immediate re-ignition when the lamp is still hot, an ignition voltage of up to 25 kV can be placed on the lamp.

By suitable selection of halogens and rare earths, a constant radiatioin of 18900 lumens, with approximately daylight characteristic, at 5600° K, and a color index Ra of more than 90 can be obtained. The arc voltage of about 45 V at a current of 6 A will result, at a rated lamp power of about 250 W with light emission of 70 lm/W.

The lamp may be operated in any position in space, and thus is highly versatile. The outstanding advantage of the lamp is its high luminous efficiency, the small and sturdy construction thereof, and, especially, the small base which permits use of a compact reflector. The lamp can readily be interchanged and removed from the socket; focussing of the lamp within the reflector is simple.

The cone surfaces of the cone 8 form, in a theoretical extension, an intersection which is preferably in the center of the arc. This insures that only a minimum of radiation from the discharge vessel will fall on the base structure itself and heats the base structure to an undesired extent. The smaller part of the cone, in which the shaft of the lamp is secured, is formed as a ring-shaped collar, surrounding the shaft of the lamp by some distance—see FIG. 3. Only the lower end of the lamp is cemented into the base structure. The portion of the cone remote from the lamp has a larger cross-sectional area than the centering stub. The two surfaces extending beyond the centering stub, and forming part of the cone, are perpendicular to the axis of the lamp and form a plane which provides an engagement surface on the cover plates 22, 23 of the socket. This results in excellent positioning of the lamp within the socket, and location of the lamp therein, in contrast to known constructions, since the engagement surface is close to the arc itself. Any tilt of the lamp—which might arise due to careless handling—within the socket thus has only slight effect.

The electrical conductor 14, connected to terminal 13, is a flat, pre-shaped, stiff metallic strip, so positioned that its narrow side faces the discharge vessel. It is carried through the surface of the cone and, as a single element, may form the second connection terminal 13 as well, in the form of a flat strip or flag connector. Placing the strip edgewise with respect to the lamp reduces heating thereof, and also eliminates the necessity for an additional welding connection between a connecting strip and a terminal pin. Elimination of such welding connections enhances the reliability of the lamp and reduces malfunction.

The two contact elements are made shorter than the centering stub of the lamp. This substantially enhances the safety of the lamp so that, when the base is inserted into the socket, the centering stub 9 will engage the wall 19 and will fit within the socket structure 18, so that the electrical terminal elements 12, 13 of the lamp will engage the corresponding terminal elements 16, 17 in the socket only later. The structure further readily permits installation of a holding element or a lamp retention device to prevent inadvertent removal of the lamp, or removal due to vibration and shock from the socket. The arrangement of the contact strip 14, and terminal 13, due to its free position and its length, facilitates installation of such a holding or retention element.

Various changes and modifications may be made within the scope of the invention concept.

I claim:

1. A single-based, high-pressure discharge lamp comprising an elongated discharge vessel (2) including two essentially aligned oppositely located current supply shafts (3, 4);

a base (5) for the vessel, of high-temperature-resistant insulating material;

a first electrical connection extending through a first one of the supply shafts, and a first (12) contact terminal means;

a second electrical connection (14) extending through the second supply shaft and a second contact terminal means (13), wherein the base (5) has a portion (8) of generally conical shape in the region adjacent the discharge vessel, and is formed with a centering stub (9) extending from the conical portion in a direction away from the discharge vessel, the centering stub (9) being formed with a lateral slot (11), the first contact terminal means (12) being located within said slot (11), with clearance;

the conical portion (8) being formed with a reception recess in which an end portion of one of the supply shafts (3) of the discharge vessel is secured;

the second electrical connection (14) extending through the cone surface of the conical portion, and the second contact terminal means (13) being located adjacent the centering stub (9) at a side thereof opposite said slot and hence opposite said first contact terminal means (12), and separated from said first contact terminal means by said centering stub (9).

2. A lamp according to claim 1, wherein said first contact terminal means (12) is located on a theoretical longitudinal axis formed by the current supply shafts (3, 4) and the longitudinal axis of the discharge vessel of the lamp.

3. A lamp according to claim 1, wherein the centering stub (9) has essentially rectangular cross section.

4. A lamp according to claim 3, further including a collar (10) secured to the centering stub (9) having at least part-circular cross section.

5. A lamp according to claim 4, wherein the first contact terminal means (12) located in said lateral slot (11) of the centering stub (9) and said part-circular collar (10) are concentric.

6. A lamp according to claim 4, wherein said first and second terminal means (12, 13) are shorter than said centering stub and the collar.

7. A lamp according to claim 1, wherein the cone angle of the generally conically shaped portion (8) of the base is selected such that the theoretical extensions of the cone surface lines interset within the discharge vessel (2).

8. A lamp according to claim 1, wherein the smaller-diameter portion of the conical poriton (8) of the base is formed as a ring-shaped collar, surrounding the respective current supply shaft (3) with clearance.

9. A lamp according to claim 1, wherein the conically shaped portion (8), in the region of the widest diameter of the conical surfaces, terminates in end portions having a diameter substantially larger than the largest cross-sectional dimension of the centering stub (9), the terminal surfaces of the conical portion ending in a theoretical plane perpendicular to the axis of the discharge vessel (2) and said shafts (3, 4) to form a flat engagement surface for a socket.

10. A lamp according to claim 1, wherein the second electrical connection (14) comprises a stiff metallic strip (14) extending through the cone surface of the conical portion, and unitary with the second contact terminal means (13), the strip being electrically connected to an electrical terminal (6) extending throught the current supply shaft (4) remote from the shaft (3) seated in the base (8).

11. A lamp according to claim 1, wherein said first and second terminal means (12, 13) are shorter than the centering stub (9).

12. A lamp as claimed in claim 1 further including a socket, wherein the socket comprises a body (18) of temperature-resistant, insulating material;

two contact terminal elements (16, 17) secured to the socket body, each having lamp terminal end portions, the socket body being formed with a recess, the socket comprising a separating wall (19) subdividing the recess of the socket body into two chambers, one of said chambers being dimensioned and shaped to receive the centering stub (9) of the lamp.

one each of the contact terminal elements being located in a respective chamber (16:20; 17:21);

wherein the socket body is formed with an access opening for said centering stub (9) and said first terminal means (12) of the lamp base thereon and for the second terminal means (13), and wherein the contact terminal element (16) in the chamber receiving the centering stub fits within the slot (11) of the centering stub (9) of the lamp and frictionally engages the first contact terminal means thereon.

13. A lamp according to claim 12, wherein the contact terminal elements (16, 17) in the socket extend laterally with respect to the central axis of the lamp.

14. A lamp according to claim 13, wherein the contact terminal elements are located in a common plane, in which said common plane extends at right angles to the axis of the lamp.

15. A lamp according to claim 12, wherein the first terminal means (12) of the lamp is concentric with a longitudinal axis of said discharge vessel and the current supply shafts (3, 4);

and one (16) of said contact terminal elements of the socket extends across said longitudinal axis of the lamp, when the lamp and its base is combined with the socket, to engage against and around said one contact terminal means (12).

16. A lamp according to claim 12, wherein said separating wall (19) comprise a rib extending upwardly in said recess of the socket.

17. A lamp according to claim 12, further including a collar (10) secured to the centering stub (9) having at least part-circular cross section;

and wherein said recess in the socket terminates in a depression dimensioned and shaped to fit around and receive said collar (10).

18. A lamp according to claim 12, wherein the conically shaped portion (8), in the region of the widest diameter of the conical surfaces, terminates in end portions having a diameter substantially larger than the largest cross-sectional dimension of the centering stub (9), the terminal surfaces of the conical portion ending in a theoretical plane perpendicualr to the axis of the discharge vessel (2) and said shafts (3, 4) to form a flat engagement surface for the socket;

and further including top cover elements (22, 23) secured to the socket body (18) and closing off said chambers, the cover elements being flat and forming engagement surfaces for the terminal surfaces of the conical portion (8) of the base to seat the base of the lamp in the socket with the conical surfaces thereof engaging and seating against the flat cover surfaces of the socket.

* * * * *